United States Patent [19]

Koehl et al.

[11] Patent Number: 5,058,290

[45] Date of Patent: Oct. 22, 1991

[54] SHOE CONSTRUCTION WITH SELF SEATING REMOVABLE HEEL

[76] Inventors: Timothy Koehl, 4817 Taft Park, Metairie, La. 70002; Joseph Mackenroth, 8117 McArthur Dr., Harahan, La. 70123

[21] Appl. No.: 399,247

[22] Filed: Aug. 28, 1989

[51] Int. Cl.[5] ..... A43B 21/36

[52] U.S. Cl. ..... 36/42; 36/36 R

[58] Field of Search ..... 36/36 R, 41, 36 A, 36 B, 36/36 C, 42, 35 R, 40

[56] References Cited

U.S. PATENT DOCUMENTS

| | | | |
|---|---|---|---|
| 380,508 | 4/1888 | Munger | 36/36 R |
| 1,156,769 | 10/1915 | Fortin | 36/36 R |
| 1,557,564 | 10/1925 | Daquino | 36/36 R |
| 1,631,710 | 6/1927 | Tranides | 36/36 R |
| 1,790,332 | 1/1931 | Tager | 36/36 R |
| 2,431,868 | 12/1947 | Gilmour | 36/42 |
| 2,439,310 | 4/1948 | Mancuso | 36/42 |
| 2,449,914 | 9/1948 | Simonette | 36/36 R |
| 2,795,866 | 6/1957 | Perugia | 36/24.5 |
| 2,795,867 | 6/1957 | Zuckerman et al. | 36/42 |
| 2,806,302 | 9/1957 | Sharpe | 36/36 R |
| 2,837,841 | 6/1958 | Twedt | 36/36 R |
| 2,943,404 | 7/1960 | Sultan | 36/42 |
| 3,581,413 | 6/1971 | Simonetti | 36/42 |
| 4,198,770 | 4/1980 | Orea Mateo | 36/42 |
| 4,214,384 | 7/1980 | Gonzalez | 36/36 R |
| 4,443,956 | 4/1984 | Caccavale | 36/36 |
| 4,610,100 | 9/1986 | Rhodes | 36/42 |
| 4,670,996 | 6/1987 | Dill | 36/42 |
| 4,805,320 | 2/1989 | Goldenberg et al. | 36/42 |
| 4,848,008 | 7/1989 | Kuehnle et al. | 36/36 R |

FOREIGN PATENT DOCUMENTS

| | | | |
|---|---|---|---|
| 11560 | of 1907 | United Kingdom | 36/36 R |

*Primary Examiner*—Steven N. Meyers

*Attorney, Agent, or Firm*—Pravel, Gambrell, Hewitt, Kimball & Krieger

[57] ABSTRACT

A high heel shoe with a self seating removable heel portion includes a shoe body having a sole portion with a toe and a heel area, the heel area being elevated substantially above the toe area so that the shoe sole is inclined between the toe and the heel and at the heel area. The heel portion of the shoe sole has a socket with a forwardly facing open end and a closed rear end, the socket having a side wall forming a continuous dove-tail joint portion. The high heel has an enlarged upper end portion with an inclined upper surface and a dove-tail locking member extends upwardly from the high heel upper end portion inclined surface, the locking member including a pedestal with a dove-tail side wall that corresponds to and registers with the socket so that the heel can be attached to the socket by moving the heel pedestal into the socket into a fore to aft direction, and wherein the heel is constantly loaded rearwardly during use insuring a seating of the heel upon the socket during use.

1 Claim, 2 Drawing Sheets

SHOE CONSTRUCTION WITH SELF SEATING REMOVABLE HEEL

BACKGROUND OF THE INVENTION

1. Field of the Invention

The present invention relates to shoe constructions and more particularly relates to a high heel shoe construction having a removable heel that affixes to the body portion of the shoe with a self loading dove-tail joint construction that is hidden upon assembly entirely within the confines of the heel so that a continuous smooth outer line defines the interface between the heel and the shoe.

2. General Background

High heel shoes are typically made of a high grade plastic or leather material with a synthetic or leather sole and having a heel which can be plastic which is strong but somewhat brittle. While this heel material works well on shoes, the outer coating of the heel is typically a designer material such as a leather veneer. During use, this outer heel covering can become cut or scuffed such as for example when the user steps into a metal grate, or between the wooden board portions of a deck, or is simply scratched against concrete curbs, lightpost or other obstruction along sidewalks.

Once the exterior of the heel is damaged, the entire shoe is rendered useless. It would thus be desirable to have a removable heel that could be replaced by the owner of the shoe. The removability and replacement should be easy to accomplish. The replacement should not be visibly apparent from the exterior of the shoe rendering its design unpleasing to the eye. Further, the removable heel construction should necessarily be a relatively inexpensive construction so that the consumer can replace the heel easily with minimum time and labor. Further, the removable heel should be of such a simple construction that a professional shoe repair facility is not required.

The removability of the heel would preferably give the user the ability to change the look of a shoe by installing a heel of a different color or size or shape.

Several United States patents have been issued relating to shoes with interchangeable or exchangeable heel constructions. However for the most part, these patents disclose complicated constructions that require metallic interfaces between the heel and the shoe, and/or the use of complicated fasteners or connectors that would render their construction too expensive and/or cumbersome to operate. Further, some require the use of extra tools so that they are an unworkable solution for the average user. Still other removable heel constructions suffer because the joint between the heel and the shoe is so readily apparent to the user that they destroy the design of the shoe rendering them unfit for intended use.

U.S. Pat. No. 4,805,320 issued to Goldberg et al., entitled "Shoe With Exchangeable Heel" discloses an article of footwear comprising a shoe having a removable and replaceable heel. Attached to the sole surface of the shoe's upper is an outwardly projecting shaft which is adapted to fit into an internal bore formed in the core of the shoe heel member. A latch mechanism is provided for inhibiting unintended separation of the heel from the upper.

U.S. Pat. No. 4,670,996 issued to Dill entitled "Women's Shoes With Flexible Spring Steel Shanks For Use With Replaceable Heels Of Different Height" shows a women's shoe with flexible shank for use with replaceable heels of different height includes a sole with a forward support portion and a raised heel portion and an overlying insole. An elongated flexible spring steel shank is nested within a slot between the insole and sole and at one end anchored thereto. A high heel registers with the heel portion and interlocking fasteners upon the heel and heel porion upon limited rotation of the heel relative to the shoe removably anchors the heel upon the shoe. The heel upon limited angular rotation and disengagement of the fasteners is adapted for removal and replacement by a low heel having similar fasteners. The shank moves within the slot to compensate for the change in height. The interlocking fasteners include opposed interconnected lock segments and anchor flanges secured respectively to the heel and heel portion. An alignment pin in the heel projects into an alignment opening in the sole preventing relative rotation of the heel and heel portion to prevent disengagement of the segments and flanges.

U.S. Pat. No. 4,610,100 issued to Rhodes entitled "Shoe With Replaceable Heel" shows a shoe with a removable heel that is attached to the shoe by means of a dove-tail connection. A high heel shoe construction is shown. The Rhodes shoe has a permanently affixed heel plate attached to the bottom of a heel support portion of the shoe. This heel plate contains a mortise having a decreasing transverse width from the front to the rear of the heel plate. A replaceable heel having a flat surface on one side and a dove-tail on the reverse surface corresponds in shape to the opening in the mortise which is slid into the mortise to be firmly seated by a friction fit on the heel plate. The rear of the heel has an outcropping of the dove-tail which is visible from the rear of the shoe.

U.S. Pat. No. 4,443,956 issued to Caccavale entitled "Shoe Replaceable Heel Kit" discloses a replaceable heel device including a heel base including a replaceable heel mounted on the bottom of the heel portion of the sole of a shoe, a replaceable heel connecting means for removably screwing said replaceable heel to the underside of the heel base and fastening means for securing the heel base to the sole. The connecting means includes a circular base plate secured to the underside of the heel base and a circular replaceable plate secured to the top of said replaceable heel. The base plate has a male threaded perimeter and the replaceable plate has a female screw threads adapted to mate with the threaded perimeter of the base plate. The connecting means for women's replaceable high heel is to secure base plate directly to heel portion of shoe sole and apply fastening means described. Included in women's replaceable high heel is a replaceable lift device, including a lift base plate fastened at the heel tip, having a female screw insert mounted therein and a male screw removably screwed into said female screw insert, said male screw being provided with replaceable lift for said female lift base plate.

U.S. Pat. No. 4,198,770 issued to Orea Mateo entitled "Device For Fixing Heels" shows a heel which is longitudinally traversed by a threaded stem provided with a head which can be activated from the lower zone of the heel and whose free end is screwed into a blind hole made centrally in a projection of the lower face of a flat cover which is adjusted in a recess made in the upper zone of the heel. The flat cover is solidly fastened to a plate arranged on the upper face of the inner sole by fixing elements which pass through the inner sole and its inner shank.

U.S. Pat. No. 3,581,413 issued to Harvey Simonetti shows a detachable heel for shoes such as ladies' or men's shoes that includes a means for permitting the manual locking or unlocking of the heel with respect to the shoes, so that heels can be placed or changed whenever desired or requires.

U.S. Pat. No. 2,943,404 issued to R. Sultan entitled "Replaceable Heel Construction", discloses a removable heel that attaches to the shoe with a metallic connector member.

U.S. Pat. No. 2,795,867 issued to M. Zuckerman et al., entitled "Shoes", shows a metal dove-tail like construction for attaching a removable heel to a shoe wherein the connection is made by pushing the heel forwardly and locking it onto the shoe.

"Ladies' Shoes" shows a removable heel construction having a metal runway rivoted to the bottom of a shoe that carries the removable heel.

U.S. Pat. No. 2,449,914 issued to H. Simonetti entitled "Detachable Heel", shows a metallic plate-like member that carries the removable heel in a detachable fashion.

U.S. Pat. No. 2,439,310 issued to F.M. Mancuso entitled "Detachable Heel", provides a dove-tail-like connection mounted from the rear to the forward portion of the shoe and a spring loaded detent locking member for securing the heel in position.

U.S. Pat. No. 2,431,868 issued to T. Gilmour entitled "Detachable Shoe Heel", provides a heel which loads onto the shoe body from the rear to the front wherein a tee-shaped cross-sectional beam is mounted on the shoe sole and a corresponding socket is formed on the heel with a locking member in the form of a transverse bar holding the heel onto the shoe.

SUMMARY OF THE PRESENT INVENTION

The present invention provides a simple yet effective connection for a high heel shoe with a removable heel portion in that the high heel is loaded during use for self seating of the heel onto the shoe, eliminating the need for complicated locking mechanisms to ensure that the heel is firmly affixed to the shoe. Further, the present invention provides an asthetically pleasing connection in that a single unbroken line defines the interface between the removable heel and the sole of the shoe body.

The present invention provides a high heel shoe construction with a self-seating removable heel portion. The shoe body includes a lower shoe sole with a toe and a heel area, the heel area being elevated substantially above the toe area so that the shoe sole is inclined between the toe and the heel, and also at the heel area. The shoe portion of a shoe sole has a socket with a forwardly facing open end portion and a closed rear end portion, the socket having a side wall forming a continuous dove-tail joint portion. A high heel is removably attached to the shoe and has an enlarged upper end portion with an inclined upper surface carrying a dove-tail locking member that extends upwardly from the high heel upper end portion inclined surface. The locking member includes a pedestal with a dove-tail side wall that corresponds to and registers with the socket so that the heel can be attached to the socket by moving the heel pedestal into the socket in a fore to aft direction. The pedestal and socket are thus loaded during normal use of the shoe, so that during walking, the heel pedestal continuously forced rearwardly into the socket, eliminating the need for transverse locking pins, springs or the like. Because the socket is closed at its rear end, the connection of the heel to the shoe body defines an unbroken line defining a plane generally parallel to the upper surface of the high heel. Thus, there are no visible outcroppings of dove-tail joints, pins, locking members or the like which are visible. The shoe connecting parts are hidden so that the shoe appears no different from the exterior than a typical prior art high heel shoe construction.

In the preferred embodiment, the apparatus provides a socket that is generally U-shaped.

In the preferred embodiment, both the socket and the pedestal are generally U-shaped and correspond to one another.

In the preferred embodiment, a layer of shock absorbing resilient material is placed as an interface between the heel and the shoe sole.

In the preferred embodiment, the pedestal is removably affixed to the high heel forming a load carrying member that can be replaced independently of the high heel itself.

In the preferred embodiment, the high heel upper surface has a socket receptive of the pedestal.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
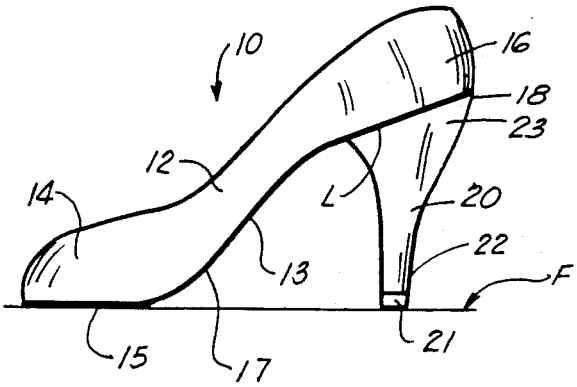
FIG. 1 is a side view of the preferred embodiment of the apparatus of the present invention.
Figure 2:
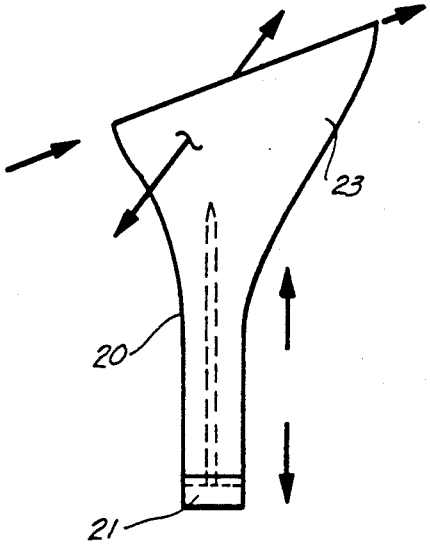
FIG. 2 is a side view of the high portion of the preferred embodiment of the apparatus of the present invention.

FIGS. 1 –6 show generally the preferred embodiment of the apparatus of the present invention designated generally by the numeral 10.

In FIGS. 1 –6, there can be seen a shoe body 12 having a sole 13, a toe area 14 and a heel area 16. The shoe sole 13 includes a forward flat portion 15 at the toe area, and an inclined 17 portion of the sole 13 that extends from the toe area 14 rearwardly to a heel 18 portion of sole 13.

A removable high heel 20 includes a lower end portion 22 which is of a smaller diameter, defining a narrowed lower section of the heel terminating at tip 21, and an upper enlarged portion 23. The heel portion 16 of the shoe includes the heel sole 18 section which has an inclined orientation when the shoe 10 fits on a flat surface F (FIG. 1).

Figure 3:
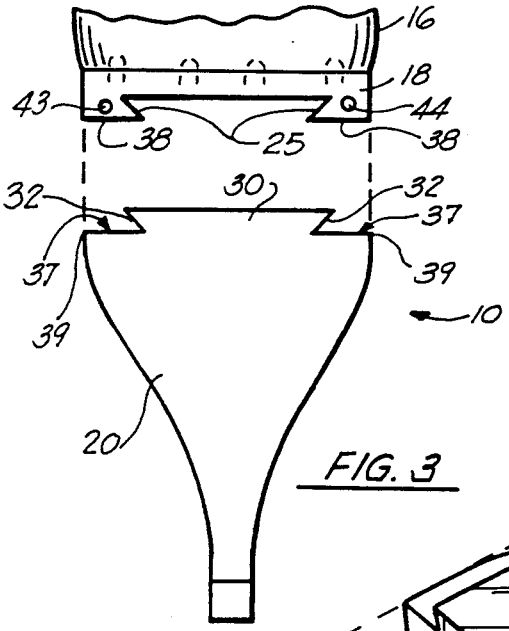
FIG. 3 is a fragmentary view of the preferred embodiment of the apparatus of the present invention.
Figure 4:
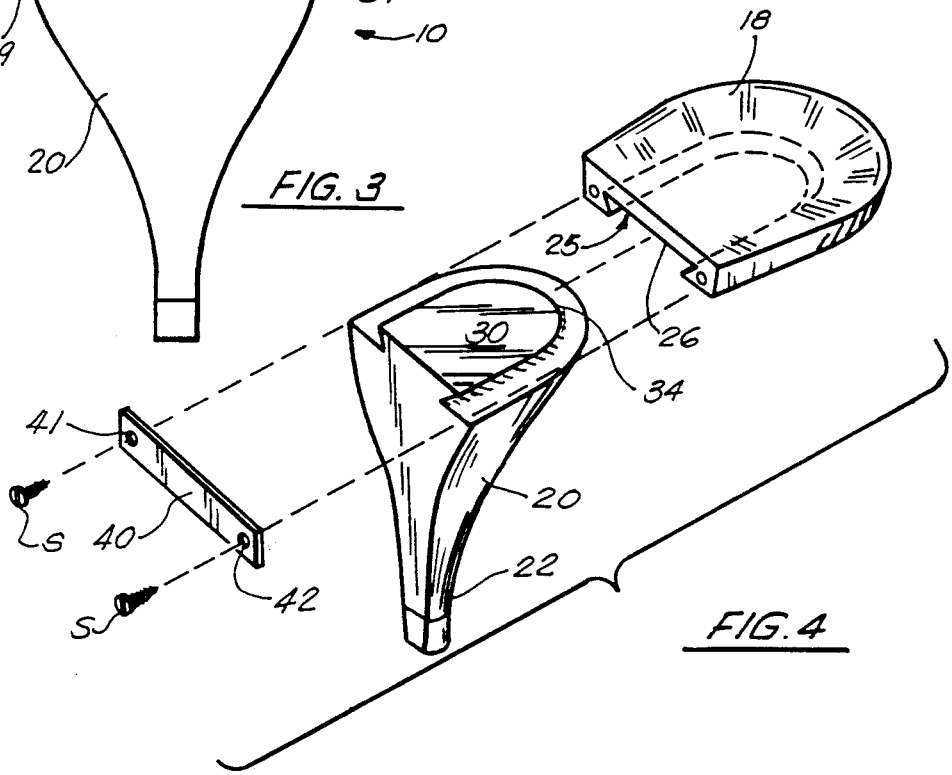
FIG. 4 is a fragmentary perspective view of the preferred embodiment of the apparatus of the present invention.
Figure 5:
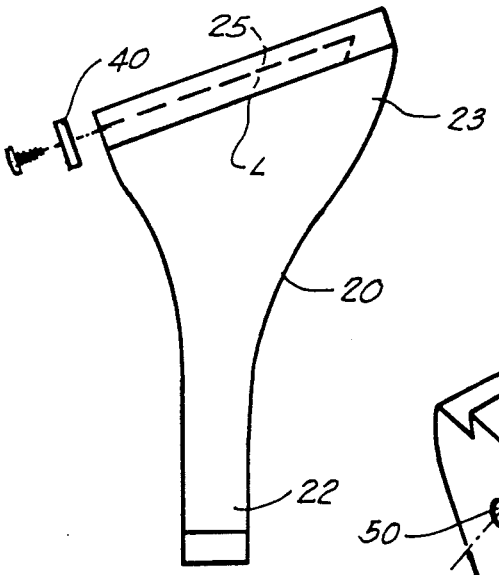
FIG. 5 is a fragmentary side view of the preferred embodiment of the apparatus of the present invention.

The heel 18 portion of the sole 13 carries socket 25 which is open at its forwardly facing end portion 26 and, which is closed at its rear end portion 28. The socket 25 is generally U-shaped having a U-shaped side wall which is inclined or beveled as shown in FIG. 3 to define a dove-tail connection that is receptive of connecting pedestal 30 portion of heel 20. Pedestal 20 provides a corresponding inclined or beveled side wall 32 which conforms in size and configuration to the socket 25 configuration as seen in FIGS. 3 and 4 so that the pedestal 30 registers into the socket 25 forming a tight fitting connection therewith. The rear end portion 28 of the socket 25 is preferably curved so that the socket is U-shaped. The rear end portion 34 of the pedestal 30 is similarly curved to register with the curved 28 portion of socket 25.

Upon assembly of the pedestal 30 into the socket 25, a rigid connection is formed between the heel 20 and the sole 18, and the U-shaped 34 portion of the pedestal 30 nests and registers with the U-shaped portion 28 of the socket 25. Because the heel 18 portion of the sole 13 and the upper surface of the pedestal 30 are inclined (FIG. 1), the heel 20 is constantly being forced rearwardly during use. As the wearer walks, a rearward load component continuously loads the pedestal 30 into the socket 25. Thus, with the present invention there is minimal chance that the removable heel 20 can be inadvertently dislocated from its operating position within the socket 25. Upon assembly of the heel 20 into the sole 18 at socket 25, a cover plate 40 can be mounted across the pedestal 30 with mounting holes 41, 42 correspondingly registering upon the mounting holes 43, 44 of the sole portion 18. Thereafter, small fasteners such as screws S can be used to completely prevent removal of heel 20 from sole portion 18.

Figure 6:
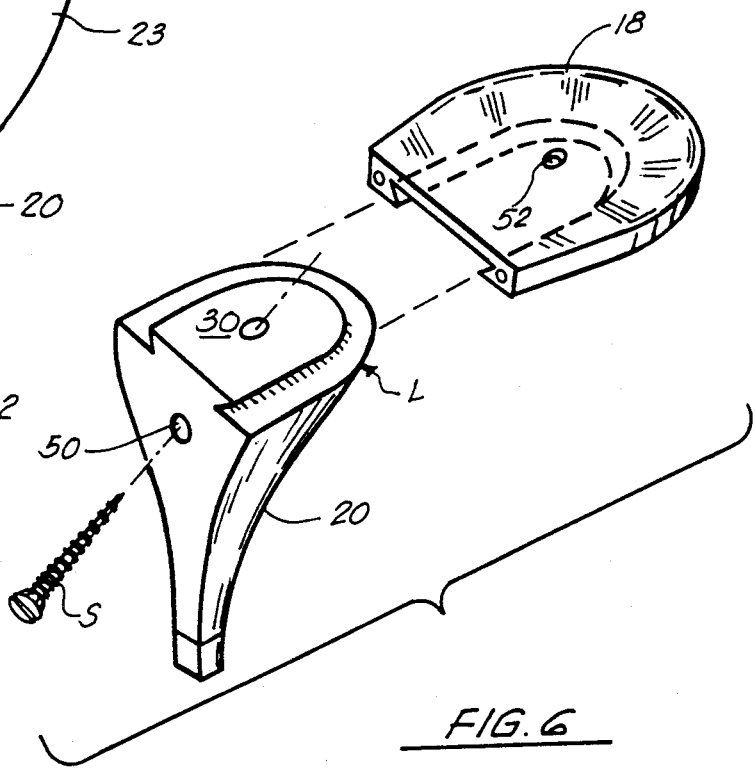
FIG. 6 is a perspective fragmentary view of the apparatus of the present invention.

In the embodiment of FIG. 6, a single inclined screw S can be attached through diagonal bore 50. Screw S penetrates through heel 20 and pedestal 30 via bore 50 and then upwardly into the opening 52 of sole 13 portion if desired to complete a threaded connection between heel 20 and sole 13.

Figure 7:
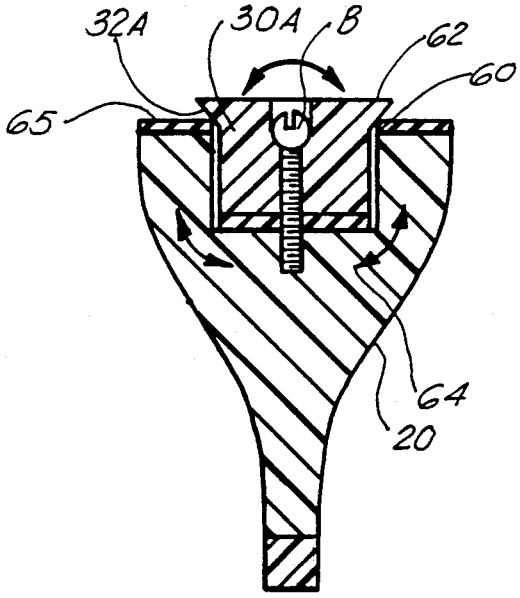
FIG. 7 is a fragmentary sectional view of a second embodiment of the apparatus of the present invention.

In the embodiment of FIG. 7, the heel 20 provides a socket 60 receptive of pedestal 30A in a removable fashion. The pedestal 30A includes a central vertical bore 62 receptive of a threaded fastener for example such as Bolt B. Beneath the pedestal 30 can be placed a resilient layer of shock absorbing material 64 such as rubber, foam or the like for cushioning the interface between pedestal 30A and heel 20. Similarly, a layer of shock absorbing material 65 can be placed about the periphery of pedestal 30A adjacent inclined dove-tail peripheral portion 32A.

The present invention provides a simple straightforward yet workable solution to the problem of connecting a heel 20 to a shoe 12 in a removable fashion and without any visible connecting parts so that the shoe 10 appears no different from a common high heel shoe. One of the features of the present invention is that there are no exposed or visible dove-tail joint portions which would render the design unpleasing to the eye. The pedestal 30 and the socket 25 are entirely contained within the confines of the outer surface of the heel 20 so that upon assembly only a smooth unbroken line L is visible, similar to the line which exists on common commercially available high heel shoes between the sole and the heel. The transverse surface 37 which extends about pedestal 30 can be sized to be slightly spaced from the transversed surface 39 that surrounds socket 25. The spacing can be for example one millimeter or the like so that leather or other covering material layered upon the heel 20 could be wrapped about the corner 39 and onto the surface 37 without interfering with the connection between pedestal 30 and socket 25.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A high heel shoe with self seating removable heel portion comprising:

(a) a shoe body having a sole with a toe and a heel area, the heel area being elevated substantially above the toe area so that the shoe sole is inclined between the toe and heel and at the heel area;

(b) the heel portion of the shoe sole having a socket with a forwardly facing open end and a closed rear end, the socket having a beveled side wall forming a dove-tail joint portion;

(c) a removable high heel having an enlarged upper end portion with an inclined upper surface;

(d) a locking member extending upwardly form the high heel upper end portion inclined surface, the locking member including a pedestal with a beveled, dove-tail side wall that corresponds to and registers with the socket so that the heel can be attached to the socket by moving the heel pedestal into the socket in a fore to aft direction;

(e) the pedestal and socket being correspondingly sized and hidden within the heel upon assembly and loaded during walking to continuously force the pedestal into the socket; and (f) the connection of the heel to the shoe body forming an unbroken exterior line defining a plane generally parallel to the upper surface of the high heel;

(g) wherein the pedestal is removably affixed to the high heel; and (h) wherein there are two layers of shock absorbing material including a first layer that is disposed beneath the pedestal and a second layer that is disposed peripherally about the pedestal.

* * * * *